US009057295B2

(12) United States Patent
Spix

(10) Patent No.: US 9,057,295 B2
(45) Date of Patent: Jun. 16, 2015

(54) POSITIVE CRANKCASE VENTILATION SYSTEM

(71) Applicant: GM GLOBAL TECHNOLOGY OPERATIONS LLC, Detroit, MI (US)

(72) Inventor: Thomas A. Spix, Rochester Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 94 days.

(21) Appl. No.: 13/784,885

(22) Filed: Mar. 5, 2013

(65) Prior Publication Data

US 2014/0251290 A1 Sep. 11, 2014

(51) Int. Cl.

| | |
|---|---|
| ***F02B 25/06*** | (2006.01) |
| ***F01M 13/04*** | (2006.01) |
| *F01M 13/02* | (2006.01) |
| *F02M 25/06* | (2006.01) |

(52) U.S. Cl.

CPC ..... *F01M 13/04* (2013.01); *F01M 2013/0438* (2013.01); *F01M 13/023* (2013.01); *F02M 25/06* (2013.01); *F01M 13/022* (2013.01)

(58) Field of Classification Search

CPC ..... F01M 13/04; F01M 2013/0438; F01M 13/023; F01M 13/22; F02M 25/06

USPC ..... 123/573

See application file for complete search history.

(56) References Cited

U.S. PATENT DOCUMENTS

2011/0056455 A1* 3/2011 Koyamaishi et al. ..... 123/196 A

* cited by examiner

*Primary Examiner* — Stephen K Cronin
*Assistant Examiner* — Charles Brauch
(74) *Attorney, Agent, or Firm* — Quinn Law Group, PLLC

(57) ABSTRACT

An engine assembly includes an engine and an intake assembly. The engine defines a combustion chamber and a crankcase, and the intake assembly includes an intake manifold in fluid communication with the combustion chamber. An air-oil separator is provided with the engine and defines a separator volume, an inlet and an outlet, where each of the inlet and outlet are in fluid communication with the separator volume. The inlet of the air-oil separator is provided in fluid communication with the crankcase, and the outlet of the air-oil separator is provided in fluid communication with the intake manifold. The air-oil separator further includes an interior surface that abuts and surrounds the separator volume, and defines a plurality of depressions, and each depression is respectively configured to retain a respective volume of fluid.

20 Claims, 2 Drawing Sheets

POSITIVE CRANKCASE VENTILATION SYSTEM

TECHNICAL FIELD

The present invention relates generally to a positive crankcase ventilation system with an air-oil separator configured to extract oil from engine blowby gasses.

BACKGROUND

During engine operation, combustion gas may leak between the cylinder and the corresponding piston rings, and into the engine crankcase. The leaked combustion gas is referred to as blowby gas, and typically includes intake air, unburned fuel, exhaust gas, oil mist, and water vapor. In an effort to ventilate the crankcase and re-circulate the blowby gas to the intake side of the engine, a positive crankcase ventilation (PCV) system may be used.

SUMMARY

An engine assembly includes an engine and an intake assembly. The engine defines a combustion chamber and a crankcase, and the intake assembly includes an intake manifold in fluid communication with the combustion chamber. An air-oil separator may be provided with the engine and may define a separator volume, an inlet and an outlet, wherein each of the inlet and outlet are in fluid communication with the separator volume.

The inlet of the air-oil separator may be provided in fluid communication with the crankcase, and the outlet of the air-oil separator may be provided in fluid communication with the intake manifold. Likewise, the air-oil separator may further include a drain that may be configured to allow separated oil to return to the crankcase. In one configuration, the drain may be gravity fed.

The air-oil separator includes an interior surface that abuts and surrounds the separator volume. The interior surface defines a plurality of depressions, each being configured to retain a respective volume of fluid. Each of the plurality of depressions may be configured to restrain its respective volume of fluid from freely flowing to the drain. In this manner, the plurality of depressions maintain a minimum average surface wetness across the interior surface of the air-oil separator. Additionally, each of the plurality of depressions has an average diameter between 1 mm and 10 mm.

The air-oil separator may further include one or more baffles extending from the interior surface into the separator volume. Each baffle may define a plurality of holes that may aid in separating the aerosol oil particulate from the flowing air.

The engine may further include an engine block, a cylinder head, an oil pan, and a cylinder head cover, and the air-oil separator may be disposed within a volume partially defined by the cylinder head and cylinder head cover.

The intake assembly may include a throttle in communication with the intake manifold. The throttle may be configured to selectively control air flow into the intake manifold. Additionally, the intake assembly may include an air cleaner in fluid communication with and located upstream of the throttle.

In a similar manner, a method of separating oil from engine blowby gas may include: venting the blowby gas from the crankcase of an engine into an air-oil separator; flowing the blowby gas through a separator volume defined by the air-oil separator, the air-oil separator having an interior surface abutting and surrounding the separator volume; and venting the blowby gas from the separator volume into an intake manifold of the engine. As mentioned above, the interior surface of the air-oil separator may define a plurality of depressions, each being configured to retain a respective volume of fluid.

The above features and advantages and other features and advantages of the present invention are readily apparent from the following detailed description of the best modes for carrying out the invention when taken in connection with the accompanying drawings.

DETAILED DESCRIPTION

Figure 1:
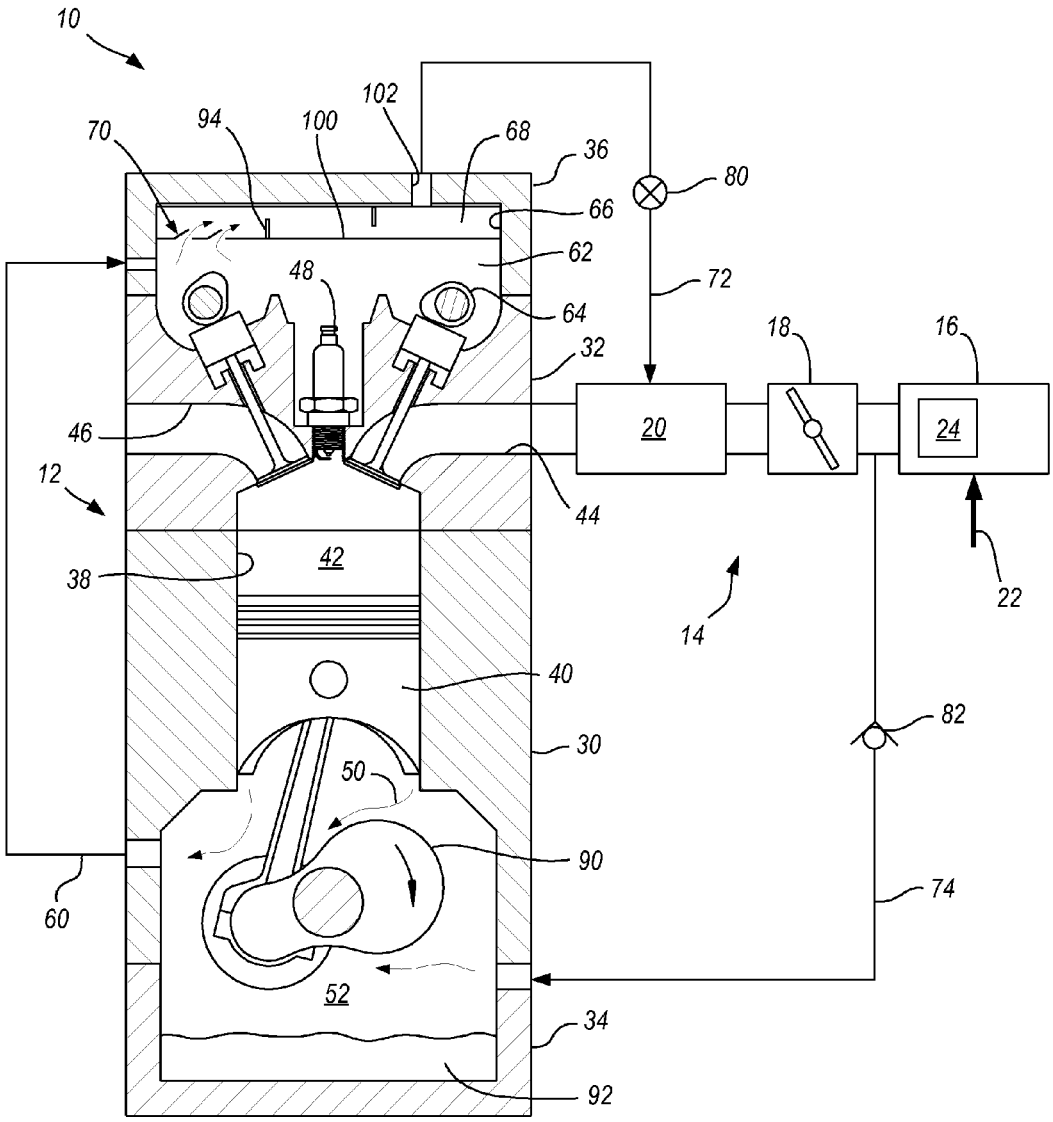
FIG. 1 is a schematic partial cross-sectional illustration of a positive crankcase ventilation system operating with an engine assembly.

Referring to the drawings, wherein like reference numerals are used to identify like or identical components in the various views, FIG. 1 schematically illustrates an engine assembly 10 including both an engine 12 and an intake assembly 14. The intake assembly 14 may include, for example, an air cleaner assembly 16, a throttle 18, and an intake manifold 20 disposed in a series arrangement. The throttle 18 may be disposed between the air cleaner assembly 16 and the intake manifold 20, and may be configured to selectively restrict the flow of air 22 into the intake manifold 20. The air cleaner assembly 16 may include housings, ports, and/or conduit that may be located upstream of the throttle 18. In one configuration, the air cleaner assembly 16 may include, for example, an air filter 24 with a sufficient porosity or other construction to filter airborne debris from the intake air 22 prior to its passage into the intake manifold 20.

The engine 12 may include an engine block 30, a cylinder head 32, an oil pan 34, and an engine cylinder head cover 36. The engine block 30 may define a plurality of cylinder bores 38 (one of which is shown), with each cylinder bore 38 having a reciprocating piston 40 disposed therein. The plurality of cylinder bores 38 may be arranged in any suitable manner, such as, without limitation, a V-engine arrangement, an inline engine arrangement, and a horizontally opposed engine arrangement, as well as using both overhead cam and cam-in-block configurations.

The cylinder head 32, engine block 30, and reciprocating piston 40 may cooperate to define a combustion chamber 42 for each respective cylinder bore 38. Additionally, the cylinder head 32 may provide one or more intake passages 44 and exhaust passages 46 in selective fluid communication with the combustion chamber 42. The intake passage 44 may be used to deliver an air/fuel mixture to the combustion chamber 42 from the intake manifold 20. Following combustion of the air/fuel mixture (such as when ignited by a spark from a spark plug 48), the exhaust passage 46 may carry exhaust gasses out of the combustion chamber 42.

During engine operation, an intake stroke of the piston 40 may draw intake air 22 through the air cleaner assembly 16, past the throttle 18, through the intake manifold 20 and intake passage 44, and into the combustion chamber 42, where fuel may be introduced via fuel injectors (not shown). During the power stroke of the piston 40, following the ignition of the air/fuel mixture in the combustion chamber 42, a portion of the combustion gas may pass between the piston 40 and the engine block 30 (i.e., blowby gas 50) and into the crankcase volume 52 (the crankcase volume 52 being generally defined by the engine 12 via the oil pan 34 and engine block 30). Because the blowby gas 50 includes an amount of un-burnt fuel and products of combustion (such as water vapor), it may be desirable to avoid having these gasses accumulate within the crankcase volume 52. Accordingly, a positive crankcase ventilation system (PCV system) may be used to purge the blowby gas 50 from the crankcase volume 52.

The PCV system may utilize ducting, passageways, and/or volumes that may actively vent the blowby gas 50 from the crankcase volume 52 into the intake system 14 where it may eventually be exhausted via the exhaust passage 46. More specifically, the PCV system may include a first fluid passageway/conduit 60 that may fluidly couple the crankcase volume 52 with a volume 62 defined by the cylinder head cover 36 (i.e., the "camshaft volume 62"). As may be appreciated, the camshaft volume 62 may contain one or more rotating camshafts 64 that are configured to translate one or more valves.

Adjacent to the camshaft volume 62, the PCV system may include an air-oil separator 66 that generally defines a separator volume 68. In one configuration, the separator volume 68 may be fluidly coupled with the camshaft volume 62 through a plurality of ports 70. The separator volume 68 may be fluidly coupled with the intake manifold 20 through a second fluid conduit 72. Additionally, the crankcase volume 52 may be coupled with the air cleaner assembly 16 through a third fluid conduit 74. Depending on the configuration of the engine 12, the first fluid conduit 60 may be, for example, a bore or channel within the engine 12, or may be, for example, a tube that extends between the crankcase volume 52 and the separator 66.

During normal operation (excluding wide-open throttle scenarios), the intake stroke of the engine 12 may generate a vacuum in the intake manifold 20 as a result of the throttle 18 partially blocking the intake air flow 22. This vacuum may draw the blowby gas 50 from the crankcase volume 52 through both the camshaft volume 62 and the separator volume 68 and into the intake manifold 20 via the first and second fluid conduits 60, 72. A portion of the air used to dilute the blowby gas 50 may be supplied via the third fluid conduit 74, which may be coupled to the air cleaner assembly 16 upstream of the throttle 18. As such, the pressure differential across the throttle 18 may generate a motive force that may actively vent the crankcase volume 52. One or more nozzles, restrictor orifices, or valves 80 may be positioned in line with the second fluid conduit 72 to provide generally constant flow under various engine operating conditions. Likewise, a check valve 82 may be positioned in line with the third fluid conduit 74 to prevent back flow from the crankcase volume 52 to the air cleaner assembly 16.

Due to engine vibrations, motion of the vehicle, the reciprocal motion of the piston 40, and/or the rotating motion of the crankshaft 90, oil 92 contained within the crankcase volume 52 may be splashed, foamed, atomized, misted and/or sprayed within the entire crankcase volume 52. The atomized/particulated oil, along with the intake air 22 and blowby gas 50, may then be drawn out of the crankcase volume 52, into the camshaft volume 62, via the first fluid conduit 60. While the atomized oil may be beneficial within the camshaft volume 62 to lubricate various moving parts (including the rotating camshafts 64), it is desirable to extract as much oil 92 as possible from the blowby gas 50 before the gas 50 passes into the intake system 14 and combustion chamber 42.

Figure 2:
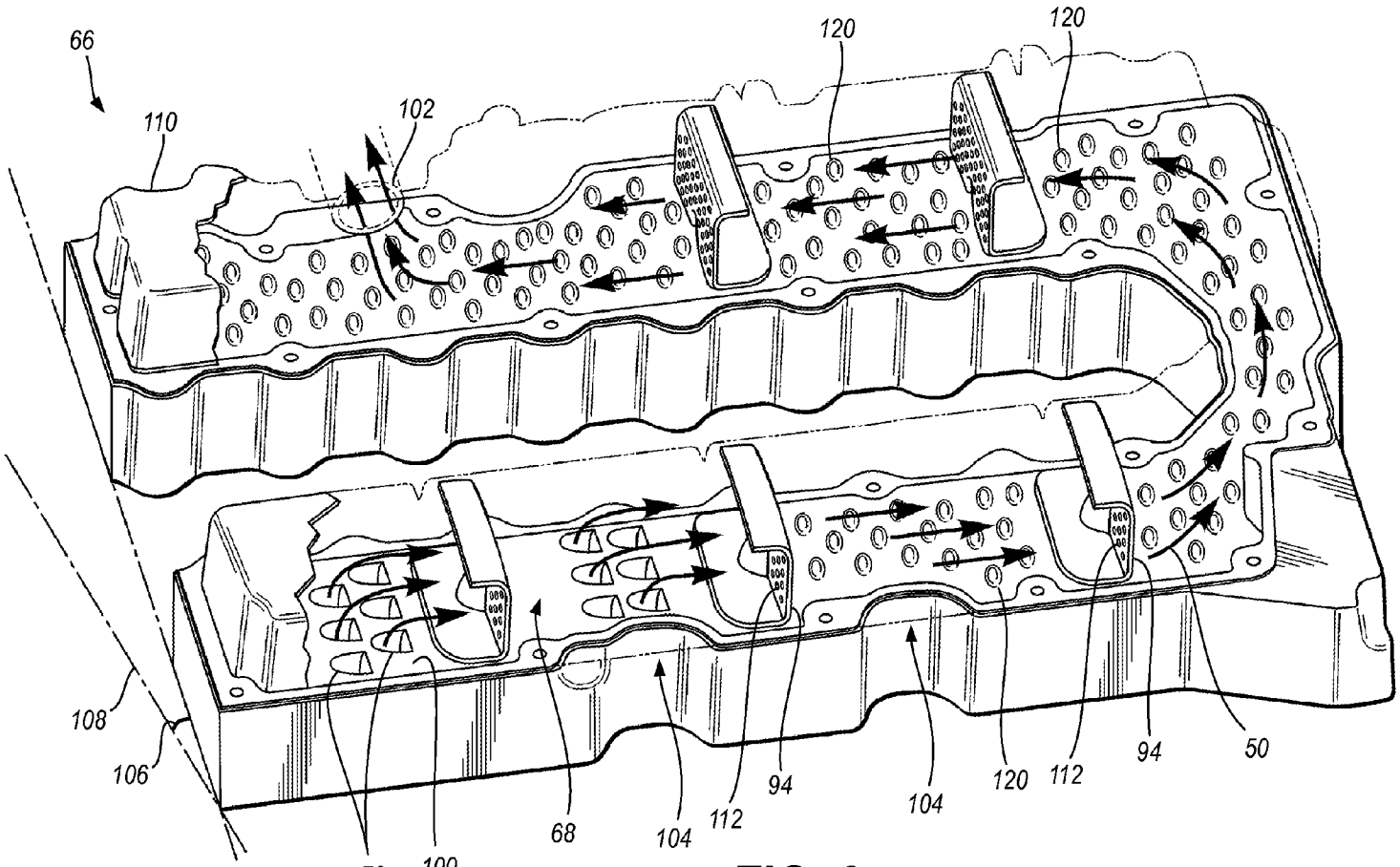
FIG. 2 is a schematic perspective view of an air-oil separator.

FIG. 2 illustrates one embodiment of an air-oil separator 66 that may be used with the present engine assembly 10. As shown, an internal surface 100 of the separator 66 may generally define the separator volume 68. The separator may include a plurality of inlet ports 70 in fluid communication with the crankcase volume 52 and/or camshaft volume 62, and may include one or more outlet ports 102 in communication with the intake system 14. A cover 110 may be disposed over the illustrated portion of the air-oil separator 66 to form a substantially closed channel between the inlet ports 70 and outlet port 102. Additionally, one or more gravity fed drains 104 may be in communication with the separator volume 68, and may allow separated oil 92 to flow out of the air-oil separator 66, and back to the crankcase 52.

To facilitate the run off of oil 92 to the drain 104, when installed with the engine 10 (i.e., in a operational position within the vehicle) the air-oil separator 66 may be disposed at an angle of inclination 106 relative to horizontal 108 ("horizontal" being defined as a plane that is orthogonal to a gravity force vector). Such an arrangement may include the air-oil separator 66 being disposed within a cylinder head cover of a V-type engine arrangement (i.e., where two banks of engine cylinders are disposed at an angle relative to each other).

To accomplish the desired oil-extraction, the separator volume 68 may be specially configured to separate and remove oil 92 from the flowing blowby gas 50 and allow the oil 92 to drain back into the crankcase volume 52. For example, the separator 66 may include one or more baffles (e.g., baffle 94), fins, or restrictions extending into the separator volume 68 that may aid in separating the oil from the air. These features may aid oil extraction through, for example, flow redirection or by creating a varying pressure along the flow path.

As generally illustrated in FIG. 2, in one configuration, a baffle 94 may define a plurality of holes 112 through which the blowby gas 50 must pass. The pressure differential across the baffle/holes 94, 112 may cause any suspended oil 92 to atomize/mist upon exiting the baffle, which may promote ultimate separation. Likewise, inertia of the particulated oil 92 may cause the oil to collide with one of the baffles 94 or internal surfaces 100 of the separator 60. Once in contact with the wall, the surface tension of the oil 92 may cause it to cling to the surface 100, where it may subsequently run off (via gravity) toward the drain 104.

It has been found that the efficiency of the air-oil separator 66 is increased when the internal surface 100 is wetted with oil 92. It is contemplated that the wetting promotes greater cohesion between the oil aerosol and the wall than a non-wetted surface would. Experimental testing has proven this improvement by witnessing an increase in separator efficiency over time, and by comparing an initially wetted separator with an initially dry separator. The difficulty, however, is that once the engine 10 is off for a prolonged period of time, any wetting oil will have a tendency to drain out of the separator 66.

Therefore, as further illustrated in FIG. 2, the interior surface 100 may include a plurality of depressions 120 that are each configured to hold a volume of oil during normal operation (i.e., each respective depression 120 is configured to restrain the respective oil from freely flowing to the drain 104). In this manner, by retaining oil in each of the respective depressions 120, the interior surface 100 may maintain a minimum surface wetness equal to the total surface area of all of the plurality of depressions 120.

In one configuration, each depression 120 may be formed using a stamping die at the same time the remainder of the air-oil separator 66 is formed (assuming a metal construction). Alternatively, each depression 120 may be molded in place during an injection molding process to form the remainder of the air-oil separator 66 (assuming a polymeric construction). For simplicity in manufacturing, each depression may have a generally spherical or generally ellipsoid-like surface profile. In either instance, the average diameter may be between approximately 1 mm and approximately 10 mm. In other configurations, different depression-profiles may be used, for example and without limitation, cubic depression-profiles and/or conical depression-profiles. As may be appreciated, the plurality of depressions 120 must be disposed on a surface that is intended to face substantially downward following final installation in the vehicle. Likewise, the angle of inclination 106 may be less than approximately 60 degrees so that each of the respective depressions may be capable of retaining its respective volume of oil, while also restraining that oil from freely flowing to the drain.

While the best modes for carrying out the invention have been described in detail, those familiar with the art to which this invention relates will recognize various alternative designs and embodiments for practicing the invention within the scope of the appended claims. All directional references (e.g., upper, lower, upward, downward, left, right, leftward, rightward, above, below, vertical, and horizontal) are only used for identification purposes to aid the reader's understanding of the present invention, and do not create limitations, particularly as to the position, orientation, or use of the invention. It is intended that all matter contained in the above description or shown in the accompanying drawings shall be interpreted as illustrative only and not as limiting.

The invention claimed is:

1. An engine assembly comprising:

an engine defining a combustion chamber and a crankcase;

an intake assembly including an intake manifold, the intake manifold being in fluid communication with the combustion chamber; and an air-oil separator defining a separator volume and further defining an inlet and outlet in fluid communication with the separator volume, the inlet of the air-oil separator being in fluid communication with the crankcase, and the outlet of the air-oil separator being in fluid communication with the intake manifold;

wherein the air-oil separator includes an interior surface that abuts and surrounds substantially the entire separator volume; and wherein the interior surface of the air-oil separator forms a plurality of depressions on the interior surface, each being configured to continuously contain a respective volume of fluid when the engine is both operating and not operating.

2. The engine assembly of claim 1, wherein the air-oil separator includes a drain; and wherein each of the plurality of depressions is configured to restrain its respective volume of fluid from freely flowing to the drain.

3. The engine assembly of claim 1, wherein the air-oil separator further includes a baffle extending from the interior surface into the separator volume.

4. The engine assembly of claim 3, wherein the baffle defines a plurality of holes.

5. The engine assembly of claim 1, wherein the engine includes an engine block, a cylinder head, an oil pan, and a cylinder head cover; and wherein the air-oil separator is disposed within a volume partially defined by the cylinder head and cylinder head cover.

6. The engine assembly of claim 1, wherein each of the plurality of depressions are respectively configured to continuously contain a volume of fluid to maintain a minimum average surface wetness across the interior surface of the air-oil separator.

7. The engine assembly of claim 1, wherein the intake assembly includes a throttle in communication with the intake manifold; and wherein the throttle is configured to selectively control air flow into the intake manifold.

8. The engine assembly of claim 1, wherein each of the plurality of depressions has an average diameter between 1 mm and 10 mm.

9. A method of separating oil from engine blowby gas comprising:

venting blowby gas from the crankcase of an engine into an air-oil separator;

flowing the blowby gas through a separator volume defined by the air-oil separator, the air-oil separator having an interior surface abutting and surrounding substantially the entire separator volume; and venting the blowby gas from the separator volume into an intake manifold of the engine; and wherein the interior surface of the air-oil separator forms a plurality of depressions on the interior surface, each being configured to continuously contain a respective volume of fluid when the engine is both operating and not operating.

10. The method of claim 9, further comprising restraining a fluid disposed in each of the plurality of depressions from freely flowing to a drain.

11. The method of claim 9, wherein each of the plurality of depressions has an average diameter between 1 mm and 10 mm.

12. The method of claim 9, wherein the engine includes an engine block, a cylinder head, an oil pan, and a cylinder head cover; and wherein venting blowby gas from the crankcase of an engine into an air-oil separator includes passing the blowby gas through the cylinder head.

13. The method of claim 9, wherein the engine includes an engine block, a cylinder head, an oil pan, and a cylinder head cover; and wherein the air-oil separator is disposed within a volume partially defined by the cylinder head and cylinder head cover.

14. An engine assembly comprising:

an engine including an engine block, a cylinder head, an oil pan, and a cylinder head cover, the engine block and oil pan partially defining a crankcase;

an intake assembly including an intake manifold, the intake manifold being in fluid communication with the combustion chamber; and an air-oil separator defining a separator volume and further defining an inlet and outlet in fluid communication with the separator volume, the inlet of the air-oil separator being in fluid communication with the crankcase via the cylinder head, and the outlet of the air-oil separator being in fluid communication with the intake manifold; and wherein the air-oil separator includes an interior surface that abuts and surrounds substantially the entire separator volume; and wherein the interior surface of the air-oil separator forms a plurality of depressions on the interior surface, each being configured to continuously contain a respective volume of fluid when the engine is both operating and not operating.

15. The engine assembly of claim 14, further comprising a fluid conduit extending between the intake assembly and the crankcase, the fluid conduit operative to allow air to pass from the intake assembly into the crankcase.

16. The engine assembly of claim 15, wherein the fluid conduit includes a check valve operative to restrict air from passing from the crankcase into the intake assembly.

17. The engine assembly of claim 14, wherein each of the plurality of depressions has an average diameter between 1 mm and 10 mm.

18. The engine assembly of claim 14, wherein the air-oil separator includes a drain; and wherein each of the plurality of depressions is configured to restrain its respective volume of fluid from freely flowing to the drain.

19. The engine assembly of claim 14, wherein the air-oil separator further includes a baffle extending from the interior surface into the separator volume.

20. The engine assembly of claim 19, wherein the baffle defines a plurality of holes.

* * * * *